United States Patent [19]

Domorazek

[11] Patent Number: 4,584,555

[45] Date of Patent: Apr. 22, 1986

[54] FAULT INDICATING CIRCUIT FOR A CURRENT CONSUMING LOAD CONNECTED TO AN ELECTRONIC SWITCHING DEVICE

[75] Inventor: Gottfried Domorazek, Ratingen, Fed. Rep. of Germany

[73] Assignee: AEG KABEL Aktiengesellschaft, Monchen-Gladbach, Fed. Rep. of Germany

[21] Appl. No.: 403,503

[22] PCT Filed: Nov. 4, 1981

[86] PCT No.: PCT/EP81/00176

§ 371 Date: Jul. 12, 1982

§ 102(e) Date: Jul. 12, 1982

[87] PCT Pub. No.: WO82/01801

PCT Pub. Date: May 27, 1982

[30] Foreign Application Priority Data

Nov. 11, 1980 [DE] Fed. Rep. of Germany ..... 3042415

[51] Int. Cl.[4] ..... B60Q 1/26

[52] U.S. Cl. ..... 340/71; 340/642; 340/644; 340/650; 340/52 B

[58] Field of Search ..... 340/71, 635, 642, 644, 340/650, 52 B

[56] References Cited

U.S. PATENT DOCUMENTS 3,550,079 12/1970 Clifford ..... 340/52 B
3,801,975 4/1974 Kitano ..... 340/642 X

FOREIGN PATENT DOCUMENTS 2203426 8/1972 Fed. Rep. of Germany .
2415157 10/1975 Fed. Rep. of Germany .
2319894 10/1975 Fed. Rep. of Germany .
2520982 8/1976 Fed. Rep. of Germany .
2519752 8/1976 Fed. Rep. of Germany .
2513481 2/1977 Fed. Rep. of Germany .
2741054 3/1979 Fed. Rep. of Germany .
3010569 10/1980 Fed. Rep. of Germany .
135021 4/1979 German Democratic Rep. .
1009434 11/1965 United Kingdom ..... 340/52 B
1592167 10/1976 United Kingdom .

OTHER PUBLICATIONS

Transistor-Handbuch-Jansen, Franzis-Verlag, (1980), p. 303.

*Primary Examiner*—John W. Caldwell, Sr.
*Assistant Examiner*—Tyrone Queen
*Attorney, Agent, or Firm*—Spencer & Frank

[57] ABSTRACT

The invention relates to a circuit for indicating faults in a current consuming load connected to an electronic switching device by means of an indicator device wherein the input of the electronic switching device receives a signal via a control line to cause the load to be switched on. The problem of reducing the number of lines leading to a central operating location is solved in that the input resistance of the electronic switching device is made to be variable by means of an impedance which is controlled by an error signal and the indicator device is actuated in dependence on the current flowing in the control line and emits a fault indication if the current in the control line deviates from the value which it has when there is no fault.

15 Claims, 4 Drawing Figures

FAULT INDICATING CIRCUIT FOR A CURRENT CONSUMING LOAD CONNECTED TO AN ELECTRONIC SWITCHING DEVICE

BACKGROUND OF THE INVENTION

The invention relates to a circuit for reporting faults in a current consuming load connected to an electronic switching device wherein the fault is reported by means of an indicating device and with a control signal causing the load to be switched on being feedable to the input of the electronic switching device via a control line.

In such a circuit, as disclosed in DE-OS 22 03 426, faults are reported over a separate line leading to a display device common to a plurality of loads.

If a plurality of loads, particularly in a motor vehicle, are to be monitored individually, a large number of lines must be brought to the central operating location, namely one control line and one report line for each load.

SUMMARY OF THE INVENTION

It is the object of the invention to reduce the number of lines leading to the central operating location.

This is accomplished by according to the invention by a circuit for reporting faults in a current consuming load connected to an electronic switching device to whose input a control signal for causing the load to be switched on can be fed via a control line, wherein the input resistance of the electronic switching device is made variable by means of an impedance controlled by a fault signal and an indicator device for reporting a fault is actuated in dependence on the current flowing in the control line if the current in the control line deviates from the value at which it flows when there is no fault. Advantageous embodiments of the invention are defined in the dependent claims.

The invention results in the advantage that faults are indicated over the control line so that no separate report lines are required.

BRIEF DESCRIPTION OF THE DRAWINGS

The invention will be explained with the aid of advantageous circuit examples which are illustrated in the drawings wherein.

DETAILED DESCRIPTION OF THE PREFERRED EMBODIMENTS

Figure 1:
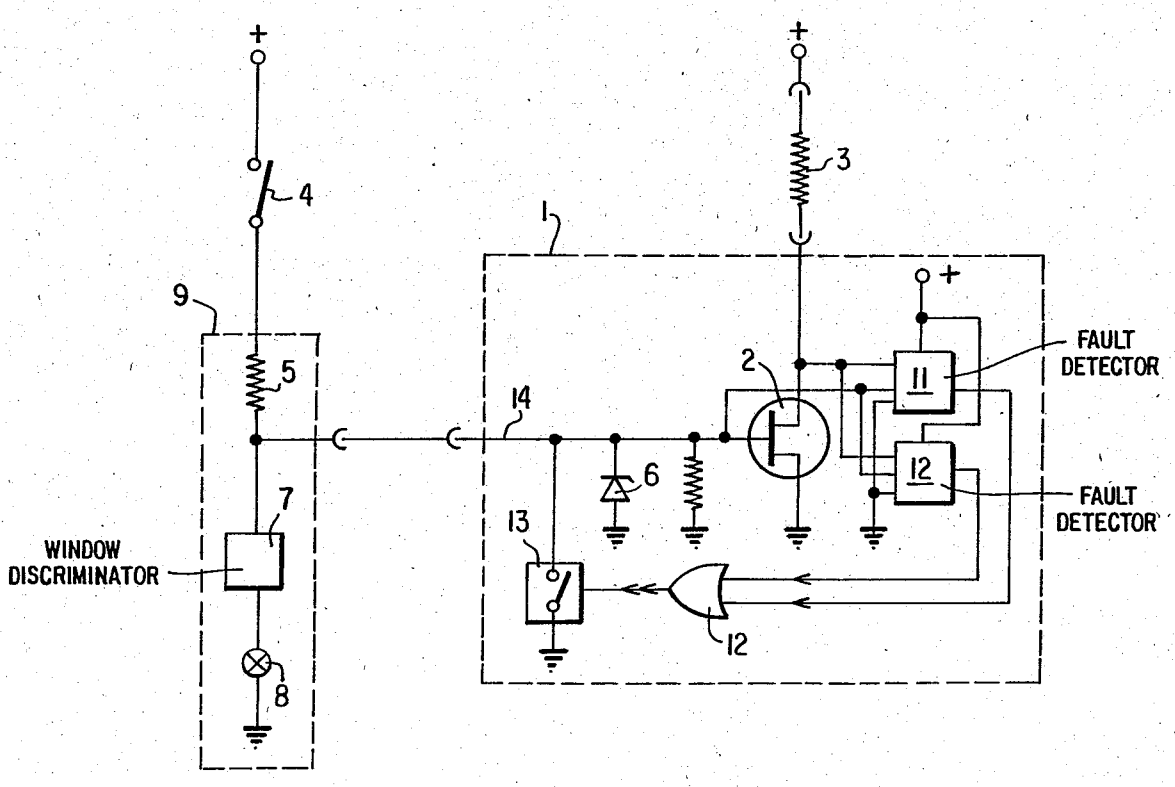
FIG. 1 is a simplified illustration of the circuit according to the invention with an indictator element in the form of an indicator lamp.

As shown in FIG. 1, an electronic switching device is marked with the reference numeral 1 and includes an input stage formed by a switching transistor 2 through which the current consuming load 3 connected to the positive pole of the voltage source is connected with ground potential which forms the negative pole. If the switch 4 disposed in a central operating location is closed, the base of transistor 2 receives, via a dropping resistor 5 and a control line 14, a control voltage which causes the load 3 to be switched on. The magnitude of this control voltage is fixed by Zener diode 6 at the value $U_z$ and is less than the voltage U of the voltage source by the voltage drop across the dropping resistor 5. This voltage $U_z$ is also present at the input of the window discriminator 7 which, however, at this value, does not permit current to pass through the indicator element, here shown as an indicator lamp 8.

Dropping resistor 5, window discriminator 7 and the indicator lamp 8 are combined in a display device 9 which is disposed in the area of the central operating location.

Fault detectors 10 and 11 are associated with the electronic switching device 1, with fault detector 10 transmitting a signal to OR gate 12 if the load is short-circuited and fault detector 11 transmitting a signal to OR gate 12 if the load current circuit is interrupted. The output signal produced at the OR gate 12 when there is a fault causes switch 13 to be closed. Switch 13 is preferably designed as a controllable semiconductor but could also be the closing contact of a relay actuated by the output signal of the OR gate 12. Switch 13 thus forms a controllable impedance which changes its value from "zero" (closed) to "infinite" (open). However it would also be possible, within the scope of the invention, to effect a change, for example if a switching transistor were used, between a first resistance value greater than zero and a second value which is greater than the first value but finite.

In any case, the difference in resistance has the result that the input resistance of the electronic switching device 1 takes on a lower value when there is a fault so that because of the then increased voltage drop across the dropping resistor 5 the input voltage to the window discriminator 7 is also reduced noticeably. The window discriminator 7 is designed in such a manner that, if there is an input voltage which is noticeably less than the value $U_z$, it emits an output current to actuate the indicator lamp 8 which thus indicates the existence of a fault. Additionally, the window discriminator 7 produces a fault indication if its input voltage is greater than $U_z$, for example if the control line 14 is interrupted due to a malfunction.

A short-circuit of the control line 14 to ground would in any case be indicated by the indicator lamp 8 lighting up because then the input voltage to the window discriminator 7 would be less than $U_z$.

Figure 4:
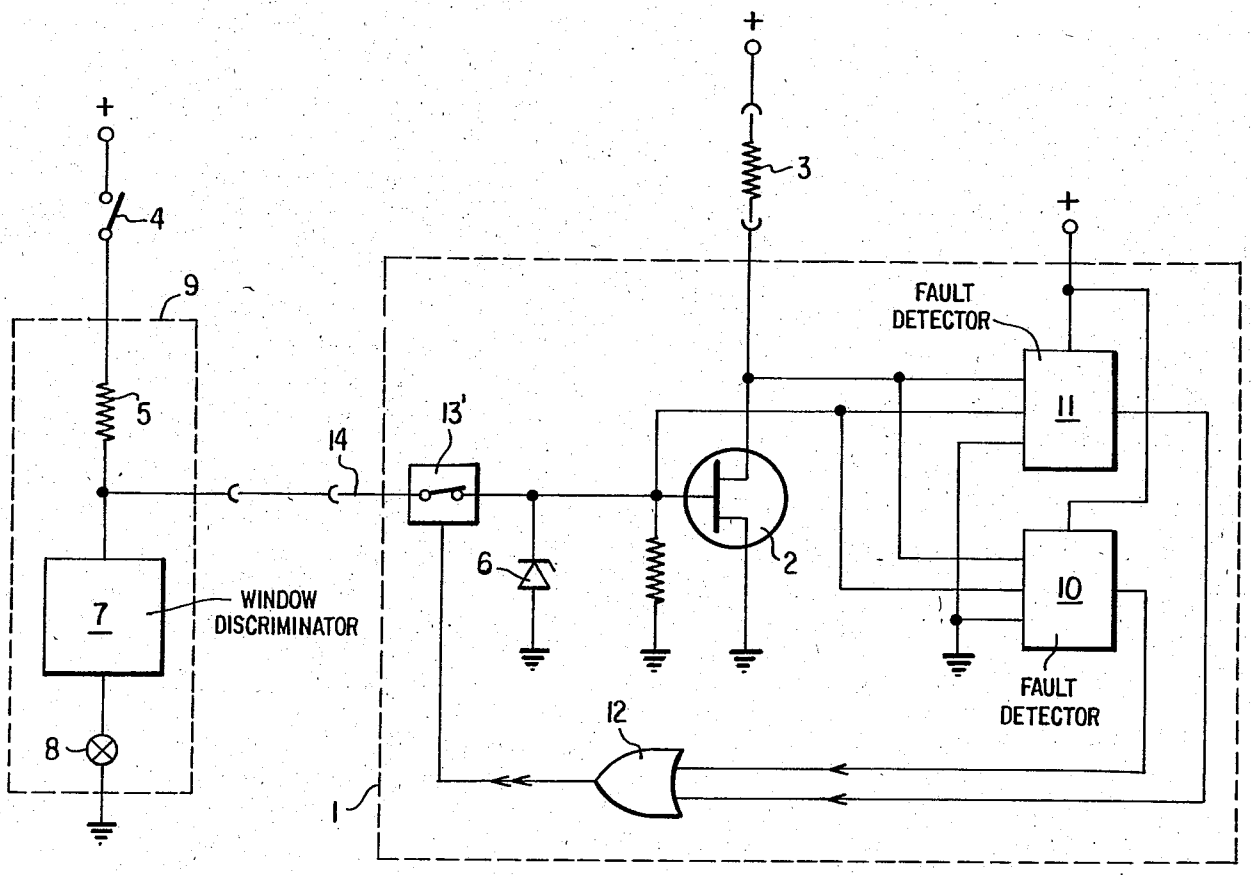
FIG. 4 is a simplified illustration of a modification of the basic circuit according to the invention shown in FIG. 1.

The input resistance measured between control line 14 and ground can of course also be varied in dependence on a fault in that switch 13' or a switching transistor controlled by the output signal of OR gate 12, respectively, is connected in series into the control circuit as shown in FIG. 4. Then, however, the switch 13' would have to be opened in the case of a fault so that a voltage greater than $U_z$ would be present at the input of the window discriminator 7 whereupon the latter would cause the indicator lamp 8 to light up.

By qualitatively evaluating the voltage present across the control line 14 behind the resistor 5 by means of the window discriminator 7, it is possible to selectively determine various types of faults.

Figure 2:
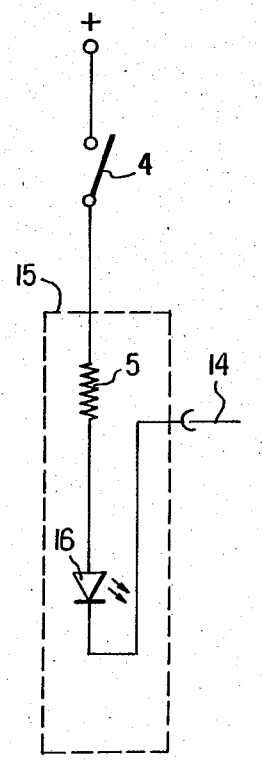
FIG. 2 shows a modification of the circuit of FIG. 1 using a light emitting diode as the indicator element.

A particularly simple indicator device 15 is shown in FIG. 2 in which faults are indicated by a light-emitting diode 16 through which current flows directly from the control line. The indicator device 15 can be used in conjunction with the electronic switching device 1 shown in FIG. 1; in that case, the Zener diode 6 is not required.

With switch 13 open, i.e. if no fault is present, a small current flows through control line 14 which does not cause the light-emitting diode 16 to light up. The current is particularly small if transistor 2 is a VMOS transistor. If OR gate 12 causes switch 13 to close as a result of a fault, or if the control line 14 is short-circuited to ground, a greater current flows which causes the light-emitting diode 16 to light up. However, the circuit according to FIG. 2 does not indicate an interruption in control line 14.

Figure 3:
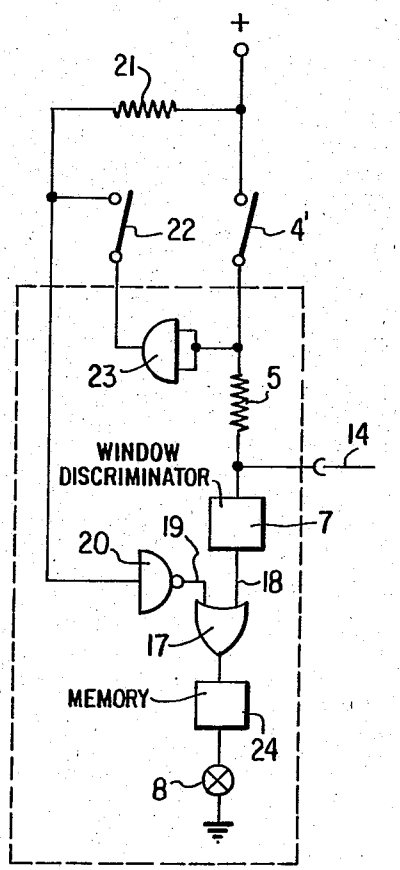
FIG. 3 shows modification of the circuit of FIG. 1 with an indicator device which additionally permits monitoring the brake light switch of a motor vehicle.

An expanded circuit for additionally monitoring the operability of the brake light switch 4' of a motor vehicle is shown in FIG. 3.

Between the window discriminator 7 and the indicator lamp 8, there is disposed an OR gate 17 which does not influence the above-mentioned fault indication via the first input 18. The second input 19 of the OR gate is connected with the output of an inverter 20 whose input is connected, on the one hand, in a high-resistance manner (resistor 21) with the positive pole of the voltage source and, on the other hand, via a control switch 22 actuatable by the pressure of the brake fluid and via an AND gate 23, which is provided for potential separation, to the connecting line between switch 4' and resistor 5.

If switch 4' is open, this connecting line is at ground potential, if switch 22 is likewise open. An H signal, which has been converted into an L signal at 19, is present at the input of the inverter 20. The indicator lamp 8 does not have current.

If the brake pedal is depressed, the brake switch 4' is closed. An H signal is present at AND gate 23. If, after the brake pressure has been built up in the master brake cylinder, the control switch 22 responds, an H signal is present at the input of inverter 20 and an L signal at the input 19 of the OR gate 17 so that the indicator 8 continues to remain without current.

If, after actuation of the brake pedal, switch 4' is not closed, for example, as a result of an incorrectly adjusted rod assembly, the inverter 20 receives an L signal once the control switch 22 has responded, causing the fault indicating lamp 8 to respond.

A fault is also indicated if switch 4' is closed with a delay only after the brake pressure has been built up and after control switch 22 has closed. Since in this case, the indicator lamp 8 would light up only briefly, it is appropriate to store the fault signal for a certain period of time with the aid of a memory cell 24.

I claim:

1. A circuit for reporting faults in a current consuming load comprising in combination an electronic switching means connected to a current consuming load and responsive to a control signal at its input for causing the load to be switched on;

signal means for selectively providing said control signal;

a control line connected between said signal means and said input of said electronic switching means;

a least one fault detecting means for providing a fault signal upon detection of a fault;

controlled impedance means connected to said input of said electronic switching means for varying the input resistance of said electronic switching means in response to receipt of a said fault signal; and indicator means connected to said control line, and responsive to the current flowing in said control line when said load is switched on, for producing a fault indication if the current in said control line deviates from the current value flowing when there is no fault.

2. Circuit according to claim 1, wherein an ohmic series resistor is connected in said control line.

3. Circuit according to claim 1 or 2, wherein said controlled impedance means is connected in parallel with the input of the electronic switching means.

4. Circuit according to claim 1 or 2, wherein said controlled impedance means is connected in series with said control line and said input of the electronic switching means.

5. Circuit according to claim 1 wherein said controlled impedance means is a controllable semiconductor.

6. Circuit according to claim 1 wherein the input stage of the electronic switching means is formed by a transistor.

7. Circuit according to claim 6, wherein said transistor is a VMOS transistor.

8. Circuit according to claim 1 wherein said indictator means is a light-emitting diode.

9. Circuit according to claim 8 wherein said light emitting diode is connected in series with said control line so that the current in the control line flows through the light-emitting diode.

10. Circuit according to claim 2 wherein said indicator means is connected to said control line between said series resistor and said input of said electronic switching means and is actuatable by a voltage reduced by the voltage drop across said series resistor.

11. Circuit according to claim 10 wherein said indicator means includes a window discriminator having its input connected to said control line and its output connected to an indicator element.

12. Circuit according to claim 10 or 11, wherein said input of the electronic switching means is connected in parallel with a Zener diode.

13. Circuit according to claim 11 wherein said signal means comprises a voltage source and a series connected switch; and further comprising; an OR gate connected between said window discriminator and said indicator element and having first and second inputs with said first input being connected to said output of said window discriminator; and circuit means for supplying a further signal to said second input of said OR gate to actuate said indicator element if said switch, which causes the load to be switched on, is not closed due to a malfunction.

14. Circuit according to claim 13 wherein; said switch is the brake light switch of a motor vehicle; and said circuit means includes a control switch which is actuated by the pressure of the brake fluid and the response of which in the case of nonclosing of said brake light switch causes said further signal to be produced at said second input of the OR gate.

15. Circuit according to claim 14 wherein said circuit means further comprises: an inverter having its output connected to said second input of the OR gate and its input connected, on the one hand, via a resistor with the common connection of said brake light switch and the positive pole of said voltage source and, on the other hand, via said control switch and a series connected potential separating element with the terminal of said brake light switch connected to said control line, and thus with the potential of said control line.

* * * * *